US011465813B2

(12) United States Patent
Young et al.

(10) Patent No.: US 11,465,813 B2
(45) Date of Patent: Oct. 11, 2022

(54) MULTI-PHASE SQUEEZE-DISPENSABLE FOOD PRODUCTS

(71) Applicant: Campbell Soup Company, Camden, NJ (US)

(72) Inventors: Casey Young, Marlton, NJ (US); Jungang Wang, Collingswood, NJ (US); Tenise Johnson, Broadlands, VA (US); Graham Jones, Philadelphia, PA (US)

(73) Assignee: Campbell Soup Company, Camden, NJ (US)

( * ) Notice: Subject to any disclaimer, the term of this patent is extended or adjusted under 35 U.S.C. 154(b) by 162 days.

(21) Appl. No.: 16/943,684

(22) Filed: Jul. 30, 2020

(65) Prior Publication Data

US 2021/0031985 A1 Feb. 4, 2021

Related U.S. Application Data

(60) Provisional application No. 62/880,490, filed on Jul. 30, 2019.

(51) Int. Cl.

| | |
|---|---|
| ***B65D 35/10*** | (2006.01) |
| ***B65D 35/46*** | (2006.01) |
| ***B65D 47/20*** | (2006.01) |

(52) U.S. Cl.

CPC ..... *B65D 35/10* (2013.01); *B65D 35/46* (2013.01); *B65D 47/2031* (2013.01)

(58) Field of Classification Search

CPC ..... B65D 35/10; B65D 35/46; B65D 47/2031
See application file for complete search history.

(56) References Cited

U.S. PATENT DOCUMENTS

| | | | | |
|---|---|---|---|---|
| 4,749,108 | A | 6/1988 | Dornsbusch et al. | |
| 5,186,223 | A * | 2/1993 | Rummage | B65G 45/22 53/391 |
| 5,292,035 | A | 3/1994 | Millar | |
| 5,307,955 | A | 5/1994 | Viegas | |
| 5,373,965 | A | 12/1994 | Halm et al. | |

(Continued)

FOREIGN PATENT DOCUMENTS

| | | |
|---|---|---|
| EP | 2463213 | 6/2012 |
| WO | 2007031330 | 3/2007 |

*Primary Examiner* — Frederick C Nicolas
(74) *Attorney, Agent, or Firm* — Pauly, DeVries Smith & Deffner LLC

(57) ABSTRACT

Embodiments herein relate to relate to multi-phase food products in deformable containers configured for squeeze dispensing. In an embodiment, a food product is included having a deformable container, wherein the container deforms under an applied force to a deformed state retaining a spring potential energy of less than 25% of the work associated with the applied force. The deformable container including a pressure operated dispensing valve in fluid communication with a channel of the deformable container. The food product further including a food material disposed within the interior volume, the food material including a liquid phase, and a solid phase. The food material having a drain weight of at least 10% and less than 50% when evaluated using a #12 sieve. The food material having a viscosity at 22.5 degrees Celsius of 12 Pa·s to 560 Pa·s at a shear rate of 0.1 [1/s]. Other embodiments are also included herein.

19 Claims, 10 Drawing Sheets

(56) References Cited

U.S. PATENT DOCUMENTS 5,377,877 A * 1/1995 Brown ..... B65D 47/2031 222/105
D364,557 S 11/1995 Linner
5,655,687 A 8/1997 Fitten et al.
5,667,107 A 9/1997 Lindsey
D398,845 S 9/1998 Wyslotsky
5,868,288 A 2/1999 Redmond, Sr. et al.
5,927,566 A * 7/1999 Mueller ..... B29C 49/02 D9/453
D423,361 S 4/2000 Negre
6,079,594 A 6/2000 Brown et al.
D429,146 S 8/2000 Thibiant et al.
6,131,806 A 10/2000 Hess, III et al.
6,152,324 A 11/2000 Baudin
6,293,437 B1 * 9/2001 Socier ..... B65D 47/2031 222/212
D459,212 S 6/2002 Gobe
6,405,901 B1 * 6/2002 Schantz ..... B65D 47/2031 222/490
6,415,965 B2 7/2002 Nyman et al.
6,616,016 B2 * 9/2003 Hicks ..... B65D 47/2031 222/212
6,705,492 B2 3/2004 Lowry
7,086,572 B2 * 8/2006 Socier ..... B65D 47/2031 222/212
D541,171 S 4/2007 Delmotte et al.
D542,660 S 5/2007 Thomas et al.
D582,790 S 12/2008 Friebe et al.
D604,164 S 11/2009 Miller et al.
7,784,652 B2 * 8/2010 Gaus ..... B65D 47/2031 222/212
D626,860 S 11/2010 Oates et al.
7,874,466 B2 1/2011 McConville et al.
D638,719 S 5/2011 Sander
7,959,036 B2 6/2011 Koh
8,087,547 B1 1/2012 Lindsey
D655,203 S 3/2012 Klint
D659,008 S 5/2012 Gately et al.
D664,862 S 8/2012 Smith et al.
D678,070 S 3/2013 Meeks
8,770,449 B2 * 7/2014 Wellman ..... B65D 47/2031 222/490
8,844,767 B1 9/2014 Bates et al.
9,682,804 B2 * 6/2017 Hatton ..... B65D 47/2025

* cited by examiner

MULTI-PHASE SQUEEZE-DISPENSABLE FOOD PRODUCTS

This application claims the benefit of U.S. Provisional Application No. 62/880,490, filed Jul. 30, 2019, the content of which is herein incorporated by reference in its entirety.

FIELD

Embodiments herein relate to food products in deformable containers. More specifically, embodiments herein relate to multi-phase food products in deformable containers configured for squeeze dispensing.

BACKGROUND

Food products come in many types of packages. Packages can include those made from polymers, metals, cellulosic materials, composites, and the like. Forms of packaging can include boxes, trays, cans, bottles, cartons, jars, tubs, bags, pouches, tubes, and the like.

Many different factors may influence the selection of appropriate packaging. Factors can include ease of manufacturing, requirements for sterility, consumer ease, consumer appeal, graphics application, ease of opening, ease of dispensing, and the like.

SUMMARY

Embodiments herein relate to multi-phase food products in deformable containers configured for squeeze dispensing. In an embodiment, a food product is included having a deformable container that can include a first flexible side wall including a top perimeter portion, a first side perimeter portion, and a second side perimeter portion, and a bottom perimeter portion, and a second flexible side wall that can include a top perimeter portion, a first side perimeter portion, and a second side perimeter portion, and a bottom perimeter portion. The first flexible side wall and second flexible side wall can define an interior volume. The first flexible side wall and the second flexible side wall can be attached to one another along the top perimeter portion, the first side perimeter portion, and the second side perimeter portion. The container can deform under an applied force to a deformed state retaining a spring potential energy of less than 25% of the work associated with the applied force. The first flexible side wall and second flexible side wall can be attached to one another along a top perimeter portion, a first side perimeter portion, and a second side perimeter portion. The first flexible side wall and the second flexible side wall can form a neck portion along their bottom perimeter portions defining a channel in fluid communication with the interior volume thereof. The deformable container can further include a pressure operated dispensing valve in fluid communication with the channel and a food material disposed within the interior volume. The food material can include a liquid phase, and a solid phase, and the food material can have a drain weight of at least 10% and less than 50% when evaluated using a #12 sieve (ASTM E-11 U.S. Sieve Number). The food material can have a viscosity at 22.5 degrees Celsius of 12 Pa·s to 560 Pa·s at a shear rate of 0.1 [1/s].

In an embodiment, the food material can be expelled from the deformable container under an externally applied force of at least 3 kg as measured with a 60 mm diameter aluminum cylinder probe at a test speed of 0.2 mm/s.

In an embodiment, the pressure operated dispensing valve can include an opening differential pressure of between 0.1 and 1 PSI.

In an embodiment, an average force required for flow of the food material out of the pressure operated dispensing valve can be less than 2.5 kg different than an average force required for valve opening at room temperature as measured with a 60 mm diameter aluminum cylinder probe at a test speed of 0.2 mm/s.

In an embodiment, an average force required for flow of the food material out of the pressure operated dispensing valve can be less than 2.0 kg different than an average force required for valve opening at room temperature as measured with a 60 mm diameter aluminum cylinder probe at a test speed of 0.2 mm/s.

In an embodiment, an average force required for flow of the food material out of the pressure operated dispensing valve can be less than 1.2 kg different than an average force required for valve opening at room temperature as measured with a 60 mm diameter aluminum cylinder probe at a test speed of 0.2 mm/s.

In an embodiment, the pressure operated dispensing valve can include an aperture with a greatest dimension of at least 0.4 inches with the pressure operated dispensing valve is in a fully open position.

In an embodiment, the pressure operated dispensing valve includes a diameter of about 0.6 to 1 inches.

In an embodiment, the first flexible side wall and the second flexible side wall define a flange along the top perimeter portion, the first side perimeter portion, and the second side perimeter portion.

In an embodiment, the deformable container can include a cap receiver connected to the neck portion and the pressure operated dispensing valve.

In an embodiment, the deformable container further can include a cap pivotably connected to the cap receiver by a hinge joint.

In an embodiment, a specific gravity of the solid phase is greater than 0.7.

In an embodiment, wherein a specific gravity of the solid phase differs from a specific gravity of the liquid phase by less than 0.4.

In an embodiment, the first flexible side wall can include a plurality of layers. In an embodiment, the second flexible side wall can include a plurality of layers. In an embodiment, wherein the first side wall and the second side wall are substantially inelastic.

In an embodiment, the food product can include a shelf-stable food product. In an embodiment, the food material can have a pH of 4.6 or less. In an embodiment, the food material can include from 8 to 40% by weight of tomato paste. In an embodiment, the food material can include from 20 to 30% by weight of tomato paste. In an embodiment, the food material can include from 23.6 to 28.6% by weight of tomato paste. In an embodiment, the food material can include from 16.3 to 19.7% by weight of tomato paste and a viscosity modifier. In an embodiment, the viscosity modifier can be selected from the group consisting of polysaccharide and protein-based viscosity modifiers. In an embodiment, the viscosity modifier can be selected from the group consisting of a microbial or vegetable gum. In some embodiments, the food product is a red salsa. In some embodiments, the food product is a green salsa (or salsa verde).

In an embodiment, a maximum width of the interior volume is less at a top portion of the deformable container than at a middle portion of the deformable container. In an embodiment, a maximum width of the interior volume tapers from a middle portion of the deformable container to a top portion of the deformable container and from the middle portion of the deformable container to a bottom portion of the deformable container.

In an embodiment, a volume of air within the interior volume is less than 5%. In an embodiment, an average maximum size of particulates in the food material is less than 0.75 inches. In an embodiment, an average maximum size of particulates in the food material is less than 0.5 inches.

In an embodiment, a pressure operated dispensing valve herein can include a snowflake flap pattern. In an embodiment, a pressure operated dispensing valve herein can include a membrane with cuts along more than two lines.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures (FIGS.), in which.

Figure 1:
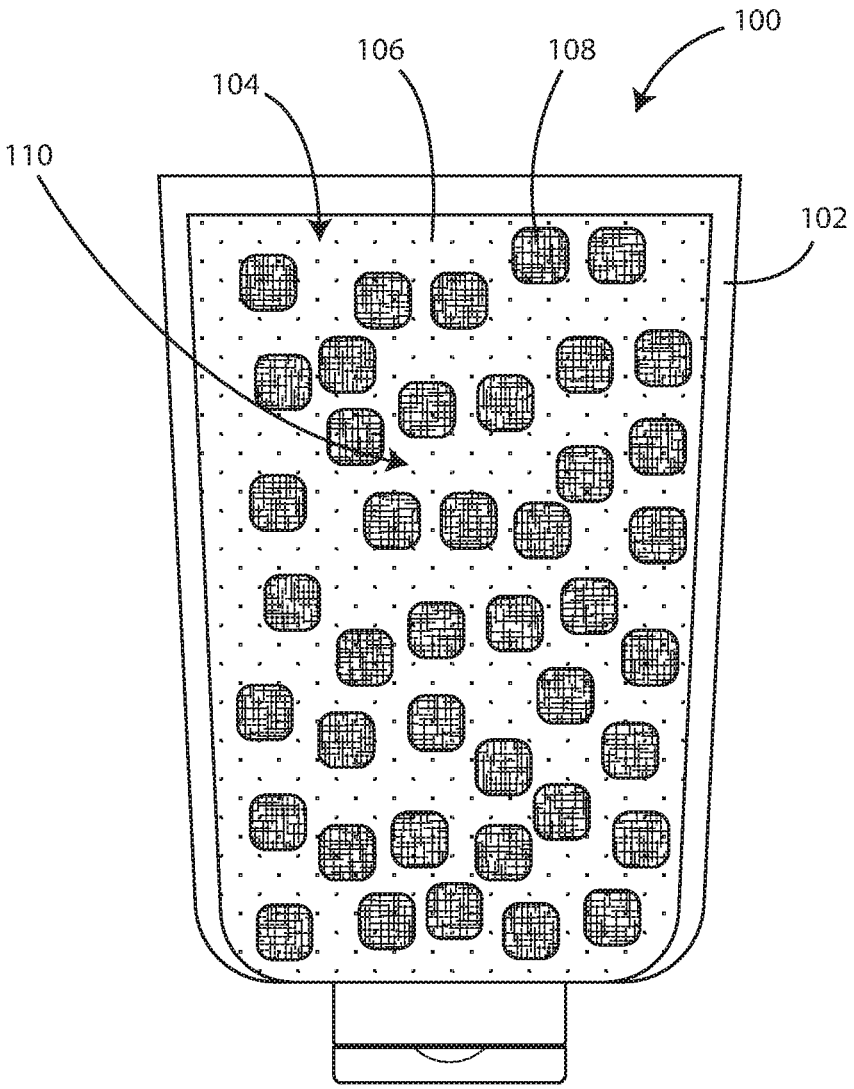
FIG. 1 is a schematic front partial sectional view of a food product in accordance with various embodiments herein.

While embodiments are susceptible to various modifications and alternative forms, specifics thereof have been shown by way of example and drawings, and will be described in detail. It should be understood, however, that the scope herein is not limited to the particular aspects described. On the contrary, the intention is to cover modifications, equivalents, and alternatives falling within the spirit and scope herein.

DETAILED DESCRIPTION

As described above, food products come in many types of packages. Squeezable containers can be useful because of their intuitive mode of dispensing product. However, it can be difficult for users to obtain desired amounts of food products from squeezable containers. In many cases, squeezing may result in an amount of food product coming out that is much larger than desired. Further, in some cases, the need to apply significant pressure may alter the direction in which the container is aimed leading to application of the food product in an unintended area.

In addition, while single phase food products have relatively simple flow characteristics, multiphase food products have much more complex flow characteristics. As a result, obtaining desirable dispensing characteristics for multiphase squeeze dispensable products remains technically challenging.

Embodiments herein relate to multi-phase food products in deformable containers configured for squeeze dispensing with desirable dispensing characteristics such as smooth and even flow. By way of example, an embodiment herein includes a deformable container having a first flexible side wall comprising a top perimeter portion, a first side perimeter portion, and a second side perimeter portion, and a bottom perimeter portion, and a second flexible side wall comprising a top perimeter portion, a first side perimeter portion, and a second side perimeter portion, and a bottom perimeter portion. Together, the first side wall and second side wall define an interior volume. The first side wall and the second side wall are attached to one another along the top perimeter portion, the first side perimeter portion, and the second side perimeter portion. The container can deform under an applied force to a deformed state having a spring potential energy of less than 25% of the work associated with the applied force.

The first and second side walls can be attached to one another along a top perimeter portion, a first side perimeter portion, and a second side perimeter portion. The first flexible side wall and the second flexible side wall forming a neck portion along their bottom perimeter portions can define a channel in fluid communication with the interior volume thereof. A pressure operated dispensing valve can be in fluid communication with the channel.

A multiphase food material can be disposed within the interior volume of the deformable container. The multiphase food material including a liquid phase and a solid phase. The food material can include a significant portion of solid phase material. By way of example, the food material can have a drain weight of at least 10% and less than 50% when evaluated using a #12 sieve. The food material can have a viscosity that enhances dispensing characteristics. By way of example, the food material can have a viscosity at 22.5 degrees Celsius of 12 Pa·s to 560 Pa·s at a shear rate of 0.1 [1/s].

Referring now to FIG. 1, a schematic front partial sectional view of a food product 100 is shown in accordance with various embodiments herein. The food product 100 includes a deformable container 102. The deformable container 102 defines an interior volume 104. A food material 110 including a liquid phase 106 and a solid phase 108 can be disposed within the interior volume. Further aspects of food materials are described in greater detail below.

The deformable container can include a valve (shown in later figures) such that food material is expelled when pressure is applied to the deformable container. For example, in various embodiments, the food material 110 is expelled from the deformable container 102 under an externally applied force 702 of at least 0.5, 1, 1.5, 2, 2.5, 3, 3.5, or 4 kg (such as measured with a 60 mm diameter aluminum cylinder probe at a test speed of 0.2 mm/s).

In various embodiments, the food product 100 can be a shelf-stable food product. In other embodiments, the food product is not shelf-stable.

In many cases, the volume of air within the deformable container 102 can be low. For example, in various embodiments, wherein the volume of air within the interior volume 104 is less than 20, 15, 10, 5, 3, or even 1% by volume.

Figure 2:
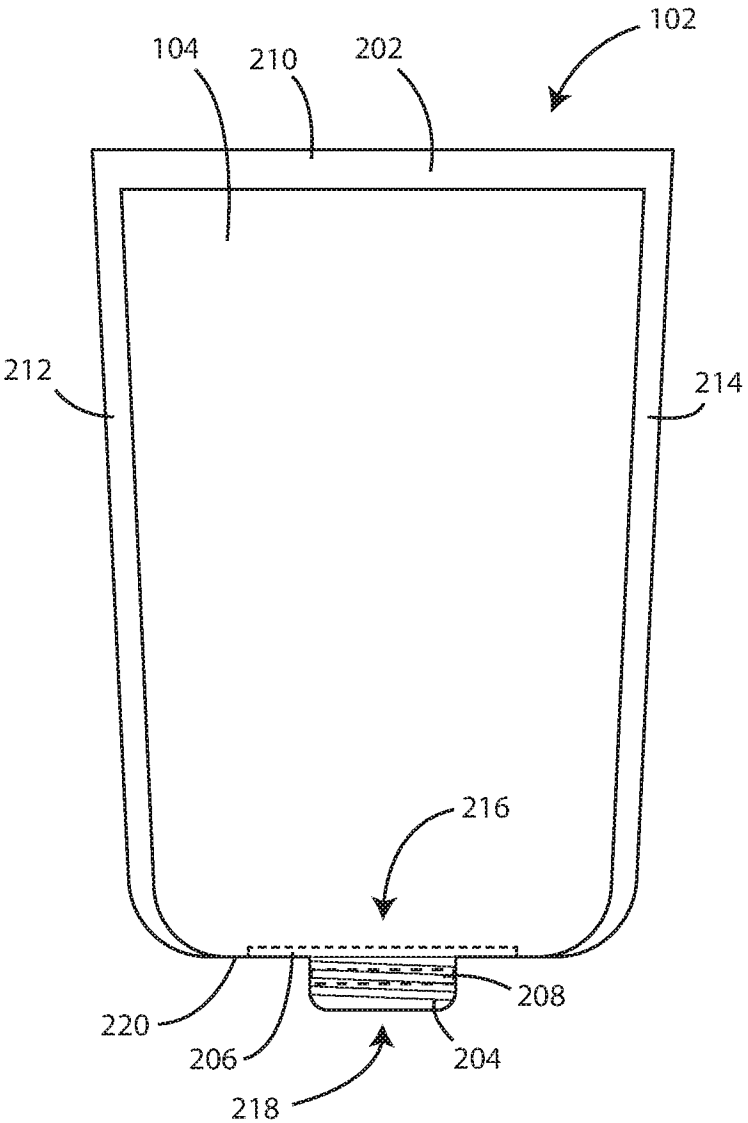
FIG. 2 is a schematic front view of a deformable container in accordance with various embodiments herein.

Referring now to FIG. 2, a schematic front view of a deformable container 102 is shown in accordance with various embodiments herein. The deformable container 102 includes a top perimeter portion 210. The deformable container 102 also includes a first side perimeter portion 212 and a second side perimeter portion 214. In some embodiments, the deformable container 102 also includes a flange 202 where layers of material forming the deformable container are attached together.

The deformable container 102 can include a first flexible side wall and the second flexible side wall forming a neck portion 216 along their bottom perimeter portions 220 defining a channel 218 in fluid communication with the interior volume 104.

The deformable container 102 can also include a pressure operated dispensing valve 208. Further aspects of exemplary valves are described in greater detail below. In various embodiments, the pressure operated dispensing valve 208 can be in fluid communication with the channel 218. The deformable container 102 also includes a spout 204 through which the channel 218 passes. The deformable container 102 also includes a spout backer 206. The spout backer 206 can be attached to the material forming the walls of the deformable container 102 and can provide a seal such that the spout 204 provides the only egress for food material within deformable container 102. In some cases, the spout 204 and spout backer 206 can be one integral component and in other cases can be two separate components.

Figure 3:
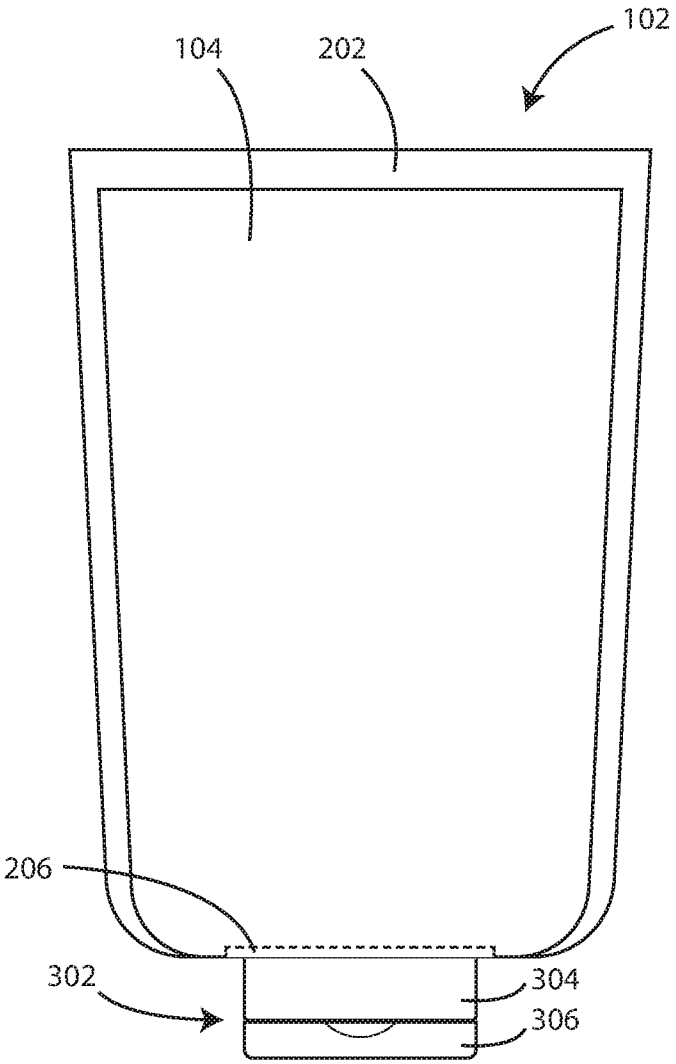
FIG. 3 is a schematic front view of a deformable container in accordance with various embodiments herein.

Referring now to FIG. 3, a schematic front view of a deformable container 102 is shown in accordance with various embodiments herein. The deformable container 102 includes an interior volume 104. The deformable container 102 also includes a cap structure 302. The cap structure 302 can fit over the spout 204. In some cases. The spout 204 can include threads and the cap structure 302 be screwed onto the spout 204. However, it will be appreciated that other connection techniques are also contemplated herein including snap-fit mechanisms, adhesives, welds, and the like.

The cap structure 302 can include a cap 306 and a cap receiver 304. The cap 306 can be pivotably connected to the cap receiver 304 by a hinge joint (not shown in this view).

Figure 4:
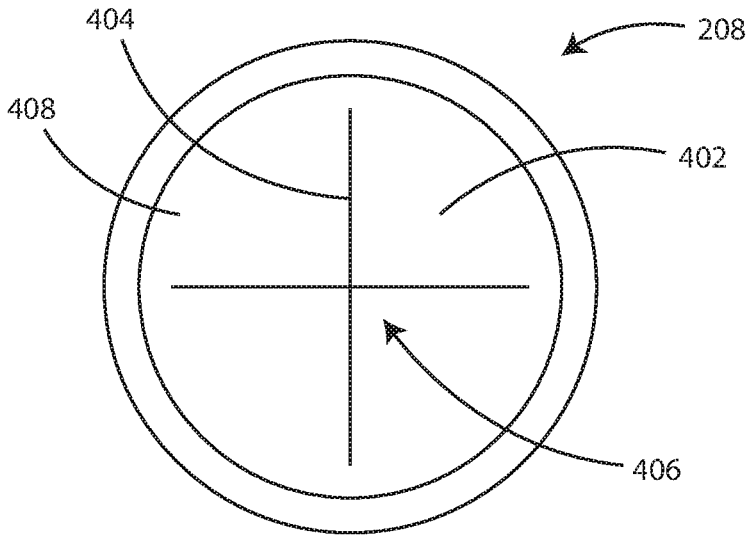
FIG. 4 is a schematic view of a valve in accordance with various embodiments herein.

Referring now to FIG. 4, a schematic view of a valve is shown in accordance with various embodiments herein. A deformable container (not shown in this view) includes a pressure operated dispensing valve 208. The pressure operated dispensing valve 208 includes a membrane 408 with cut lines 404 therein. The membrane 408 can be formed of various materials such as polymers and the like. In various embodiments, the membrane 408 can have a thickness of about 0.5, 0.75, 1, 1.25, 1.5, 1.75, 2, 2.25, 2.5, 2.75, or 3 mm or a thickness falling within a range between any of the foregoing.

The cut lines 404 of the pressure operated dispensing valve 208 form flaps 402. When the flaps 402 open, they form an aperture 406. In this case, there are two cut lines 404 forming four flaps 402. However, it will be appreciated that many different numbers of cut lines and flaps are contemplated herein. By way of example, the valve can include 2, 3, 4, 5, 6, 7, 8, 9, 10, 11, 12 or more flaps, or a number of flaps falling within a range between any of the foregoing.

The pressure operated dispensing valve 208 can have an opening differential pressure that is sufficiently high to prevent premature dispensing of the food material and sufficiently low to not require undue force on the part of the consumer. In various embodiments, wherein the pressure operated dispensing valve 208 comprising an opening differential pressure of 0.1, 0.2, 0.3, 0.4, 0.5, 0.6, 0.7, 0.8, 0.9 or 1 PSI, or an amount falling within a range between any of the foregoing.

In various embodiments, the food product can exhibit a differential pressure between the force required to open the valve and the force required to cause food material that is sufficiently low that food material can be dispensed in a smooth, controllable manner. In various embodiments, wherein the average force required for flow of the food material 110 out of the pressure operated dispensing valve 208 is less than 5.0, 4.5, 4.0, 3.5, 3.0, 2.5, 2.0, 1.2, or 1.0 kg different than the average force required for valve opening at room temperature (such as measured with a 60 mm diameter aluminum cylinder probe at a test speed of 0.2 mm/s) or an amount falling within a range between any of the foregoing.

The dispensing valve 208 can have an aperture 406 that when opened (such as by the flaps bending) is sufficiently large to let solid phase components pass therethrough. In various embodiments, the pressure operated dispensing valve 208 comprising an aperture 406 with a greatest dimension of at least 0.2, 0.25, 0.3, 0.35, 0.4, 0.45, 0.5, 0.55, 0.6, 0.65, 0.7, 0.75, 0.8, 0.85, 0.9, 0.95, or 1.0 inches, or an amount falling within a range between any of the foregoing when the pressure operated dispensing valve 208 is in a fully open position.

The dispensing valve 208 itself can have various diameters. In various embodiments, the dispensing valve 208 can have a diameter of about 0.3, 0.35, 0.4, 0.45, 0.5, 0.55, 0.6, 0.65, 0.7, 0.75, 0.8, 0.85, 0.9, 0.95, 1.0, 1.1, 1.25, or 1.5 inches, or an amount falling within a range between any of the foregoing.

Figure 5:
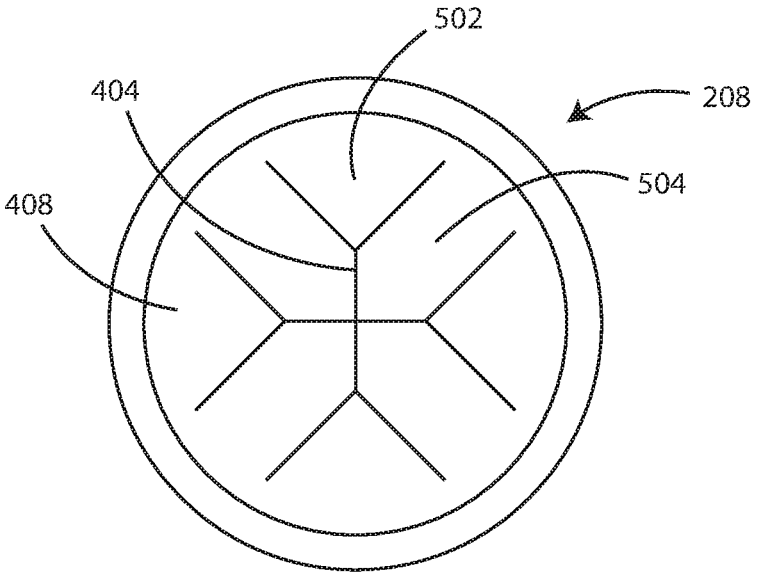
FIG. 5 is a schematic view of a valve in accordance with various embodiments herein.

It will be appreciated that dispensing valves herein can take on many different shapes and patterns. Referring now to FIG. 5, a schematic view of a dispensing valve 208 is shown in accordance with various embodiments herein. The pressure operated dispensing valve 208 includes cut lines 404. In this case, the cut lines 404 form a snowflake flap pattern including small flaps 502 and big flaps 504.
As before, the dispensing valve 208 can include a membrane 408, but in this case with cuts along more than two lines.

Figure 6:
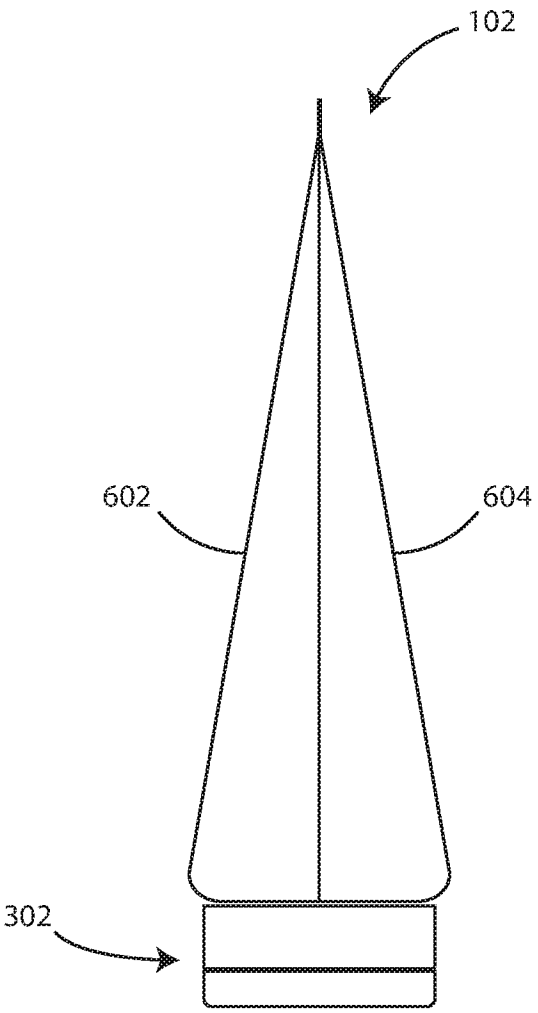
FIG. 6 is a schematic side view of a food product in accordance with various embodiments herein.

Referring now to FIG. 6, a schematic side view of a food product is shown in accordance with various embodiments herein. As before, the food product includes a deformable container 102. In this example, the deformable container 102 includes a first flexible side wall 602. The deformable container 102 also includes a second flexible side wall 604. The deformable container 102 also includes a cap structure 302.

The first flexible side wall 602 and the second flexible side wall 604 can include a variety of materials. In some embodiments, the first flexible side wall 602 and the second flexible side wall 604 can each include a single layer of a material.

In other embodiments, the first flexible side wall 602 and the second flexible side wall 604 can each include a plurality of layers, such as 2, 3, 4, 5, 6, or more layers. Exemplary materials for the first flexible side wall 602 and the second flexible side wall 604 can each include polymers, metals, metallized materials, adhesives, and the like.

In various embodiments, the first flexible side wall 602 and the second flexible side wall 604 are substantially inelastic. For example, the first flexible side wall 602 and the second flexible side wall 604, while very deformable and flexible do not stretch to a significant degree under an applied force. For example, the first flexible side wall 602 and the second flexible side wall 604 can stretch less than 20, 15, 12, 10, 9, 8, 7, 6, 5, 4, 3, 2, or 1% under an applied tensile stress of 5 kg.

It will be appreciated that deformable containers herein are not limited to just those with two flexible side walls. Rather, many different constructions are contemplated herein. In some cases, there can be three, four, five or more distinct side walls or panels that are assembled to form the deformable container.

Figure 7:
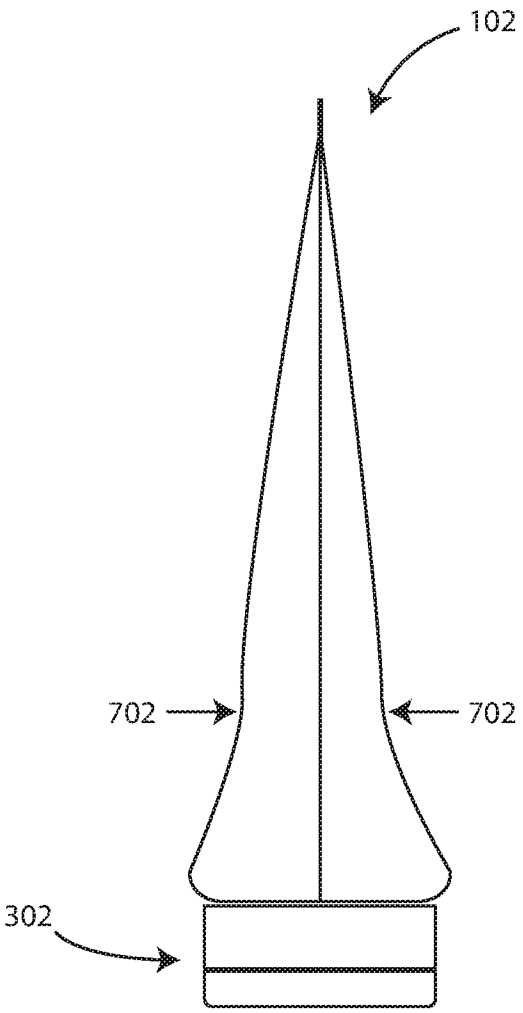
FIG. 7 is a schematic side view of a food product in accordance with various embodiments herein.

Referring now to FIG. 7, a schematic side view of a food product is shown in accordance with various embodiments herein. A food product (not shown in this view) includes a deformable container 102. In this view, a force 702 is being applied to the deformable container 102. However, very little of the force 702 is stored as potential energy and therefore the deformable container 102 tends not to rebound when the force 702 is no longer being applied (such as when a consumer releases their grip on the container). In various embodiments, the container deforms under an applied force to a deformed state but retains a spring potential energy of less than 40, 35, 30, 25, 20, 15, 10, 7.5, 5, or 2.5% (or an amount falling within a range between any of the foregoing) of the mechanical work associated with the applied force.

Figure 8:
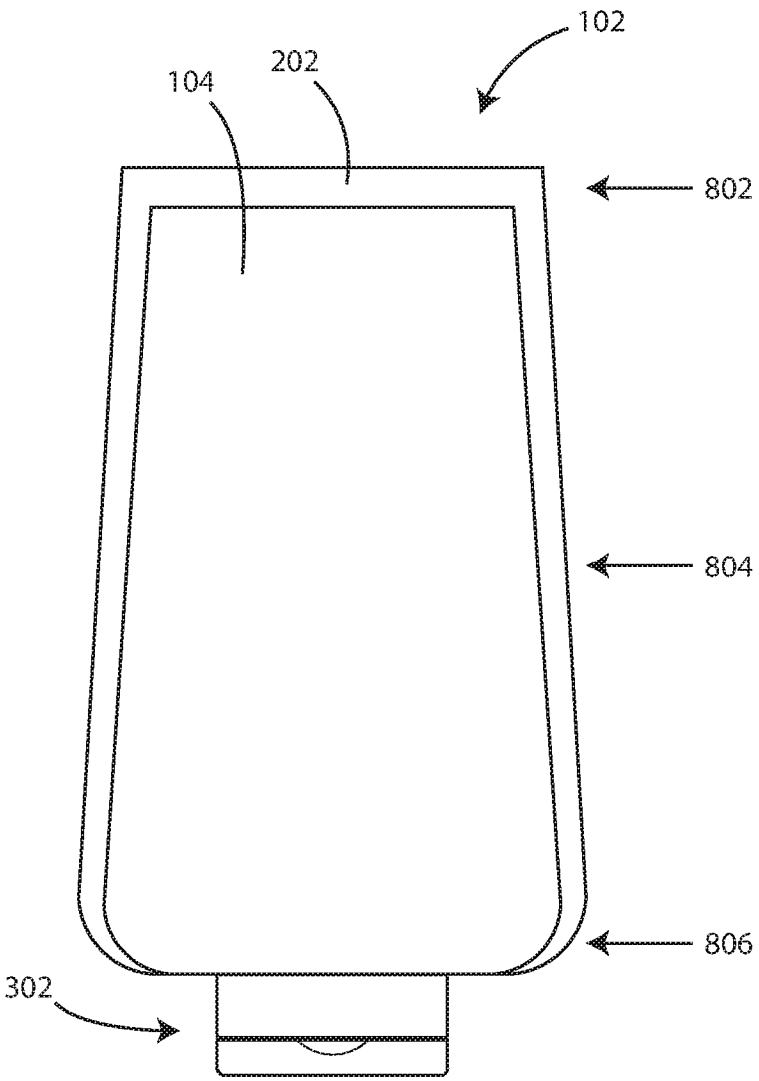
FIG. 8 is a schematic front view of a food product in accordance with various embodiments herein.

Many different overall shapes of deformable containers are contemplated herein. In some cases, the deformable container can have a top that is wider than the bottom, such as shown in FIGS. 1-3. However, in other cases, the top may be narrower than the bottom. In still other cases, the top and the bottom can be narrower than a middle area. Referring now to FIG. 8, a schematic front view of a food product is shown in accordance with various embodiments herein. The food product includes a deformable container 102. The deformable container 102 includes an interior volume 104. The deformable container 102 also includes a cap structure 302. The deformable container 102 includes a top portion 802. The deformable container 102 also includes a middle portion 804. The deformable container 102 also includes a bottom portion 806. In this example, a maximum width of the interior volume 104 is less at a top portion 802 of the deformable container 102 than at a middle portion 804 of the deformable container.

Figure 9:
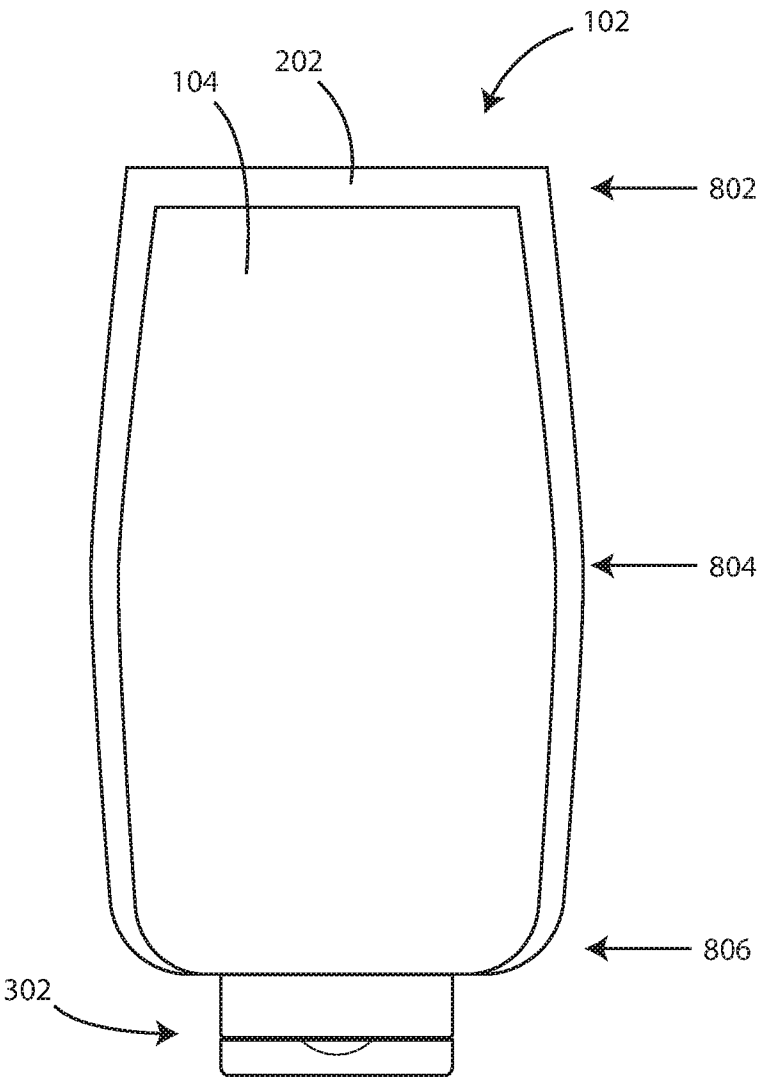
FIG. 9 is a schematic front view of a food product in accordance with various embodiments herein.

Referring now to FIG. 9, a schematic front view of a food product is shown in accordance with various embodiments herein. The food product includes a deformable container 102. FIG. 9 is generally similar to FIG. 8. However, in this embodiment, the maximum width of the interior volume 104 tapers from a middle portion 804 of the deformable container 102 to a top portion 802 of the deformable container 102 and from the middle portion 804 of the deformable container 102 to a bottom portion 806 of the deformable container.

Food Materials

Many different food materials are contemplated herein. As described above, in various embodiments food materials herein are multiphase food materials. By way of example, the food materials herein can have a solid phase and a liquid phase.

The liquid phase can be aqueous. The solid phase can be formed of solid food particulates having sufficient size so as to contribute to a measurable drain weight of the food material. In various embodiments, the food material can have a drain weight of at least 5, 10, 15, 20, 25, 30, 35, 40, 45, 50, 55, 60, 65, or 70% when evaluated using a #12 sieve, or a drain weight falling within a range between any of the foregoing. By way of example, the food material can have a drain weight of at least 10% and less than 50% when evaluated using a #12 sieve. As another example, the food material can have a drain weight of at least 20% and less than 40% when evaluated using a #12 sieve.

Drain weight as referenced herein can be assessed according to the following procedure. First, the sample can be emptied onto a #12 sieve and rinsed with water until all sauce has been washed from the solid food particulates. The sieve can then be allowed to drain for 2 minutes at a 45-degree angle. Excess water can then be wiped from the surfaces and then a weight measurement can be taken and the percentage calculated by dividing the resulting weight measurement by the original total weight and then multiplying by 100.

It has been found herein that solid phase particulates that are too great in size may hinder smooth and even product dispensing/flow. In various embodiments, the average maximum size of particulates in the food material is less than 1.0, 0.75, 0.6, 0.5, 0.4, 0.3, 0.25, 0.2 or 0.1 inches, or an amount falling within a range between any of the foregoing. However, solid phase particulates that are too small may not meet consumer expectations of what the food material appearance and mouthfeel should be like. As such in some embodiments, the average maximum size of particulates in the food material is greater than 0.05, 0.1, 0.15, 0.175, 0.2, or 0.225 inches, or an amount falling within a range between any of the foregoing.

While not intending to be bound by theory, it is believed that if the specific gravity of the solid phase is close to that of the liquid phase, then less settling will occur of solid phase components if the product is stored on a shelf for a period of time before initial purchase or in between consumer uses. This is significant because food products herein are primarily designed to be stored with their caps at the bottom, meaning that settling of solid phase components can result in positioning of disproportionately large amounts of solid phase particulates on or near the valve leading to unpredictable and often undesirable flow properties.

In various embodiments, the specific gravity of the solid phase is about 0.65, 0.7, 0.75, 0.8, 0.81, 0.82, 0.83, 0.84, 0.85, 0.9, 0.95, 1, 1.05 or 1.1, or an amount falling within a range between any of the foregoing. In various embodiments, the specific gravity of the liquid phase is about 0.85, 0.9, 0.95, 1, 1.025, 1.05, 1.075, 1.1, 1.15, 1.2, or an amount falling within a range between any of the foregoing. In various embodiments, the specific gravity of both the solid phase and the liquid phase is about 0.8, 0.85, 0.9, 0.95, 1, 1.025, 1.05, 1.075, 1.1, 1.15, 1.2, or an amount falling within a range between any of the foregoing. In various embodiments, the specific gravity of the solid phase differs from the specific gravity of the liquid phase by less than 0.4, 0.35, 0.3, 0.25, 0.2, 0.15, 0.1, 0.075, 0.05, 0.025 or 0.01, or an amount falling within a range between any of the foregoing.

The food material can have various specific pH values depending on the type of food and the desired stability. In various embodiments, the food material can have a pH of 9, 8.5, 8, 7.5, 7, 6.5, 6, 5.5, 5.0, 4.5, or 4, or a pH falling within a range between any of the foregoing. In various embodiments, the food material can specifically be acidic. For example, in various embodiments the food material can have a pH of 4.6 or less.

The food material can include various components to result in desired viscosities. Many different ingredients can be used to control viscosity. In some embodiments herein, tomato paste is added to control viscosity and result in a product that exhibits smooth and even flow characteristics. In some embodiments, the food material can include at least about 10, 15, 20, 25, 30, 35, 40, 45, 50, or even 60% by weight of tomato paste, or an amount falling within a range between any of the foregoing. For example, in in various embodiments, the food material 110 can include from 10 to 40% by weight of tomato paste. In various embodiments, the food material 110 can include from 23.6 to 28.6% by weight of tomato paste.

The total amount of tomato solids in the resulting composition can be about 3, 4, 5, 6, 7, 8, 9, 10, 11, 12, 15, 18 or 21% total solids (which includes both soluble and insoluble solids versus NTSS based measurement), or an amount falling within a range between any of the foregoing.

In some embodiments, the food material 110 can include from 8 to 30% by weight tomato paste and a viscosity modifier. In some embodiments, the food material 110 can include about 26% by weight tomato paste and a viscosity modifier.

Many different viscosity modifiers are contemplated herein. In some embodiments, the viscosity modifier can include polysaccharide and protein-based viscosity modifiers. In some embodiments, the viscosity modifier can include a microbial or vegetable gum. Exemplary viscosity modifiers can include, but are not limited to, arrowroot, cornstarch, katakuri starch, potato starch, sago, wheat flour, almond flour, tapioca, alginin, guar gum, locus bean gum, xanthan gum, collagen, egg whites, gelatin, carboxymethyl cellulose, pectin, carrageenan, and the like, and combinations thereof. The amount of the viscosity modifier can vary. In some embodiments, the amount of the viscosity modifier is at least about 0.1, 0.25, 0.5, 0.75, 1, 1.25, 1.5, 1.75, 2, 2.5, 3, 3.5, 4, 5, 7.5, 10, 12.5, 15, 17.5, 20 or 25% by weight, or an amount falling within a range between any of the foregoing. In some embodiments, the amount of the viscosity modifier can be about 17.9% by weight.

The food material can have a viscosity that enhances dispensing characteristics. In various embodiments, when measured at a shear rate of 0.1 [1/s] and 22.5 degrees Celsius, the food material can have a viscosity of 8, 10, 12, 14, 16, 18, 20, 30, 45, 60, 75, 90, 105, 120, 150, 175, 200, 250, 300, 350, 400, 450, 500, 515, 530, 545, 560, 575, or 590 Pa·s or an amount falling within a range between any of the foregoing. By way of example, in some embodiments, the food material can have a viscosity at 22.5 degrees Celsius of 12 Pa·s to 560 Pa·s to at a shear rate of 0.1 [1/s].

In some embodiments, the food material is a red salsa. In some embodiments, the food material is a green salsa (or salsa verde).

Other components of the food material can include, but are not limited to, crushed tomatoes, jalapeno peppers, diced tomatoes, tomato juice, carrots, onions, vinegar, salt, dehydrated onions, garlic, flavorings, sweeteners, preservatives, and the like.

Aspects may be better understood with reference to the following examples. These examples are intended to be representative of specific embodiments, but are not intended as limiting the overall scope of embodiments herein.

EXAMPLES

Example 1: Effect of Viscosity Changes on Variations Force Required for Valve Opening and Product Dispensing A texture analyzer (TA-XT Plus) with a round plate probe with a diameter of 60 mm was used to apply force and measure the pressures. Samples were placed at the same location on the platform of texture analyzer. For each test, the middle area of the pouch was pressed with the probe and the corresponding forces and distances were recorded.

Figure 11:
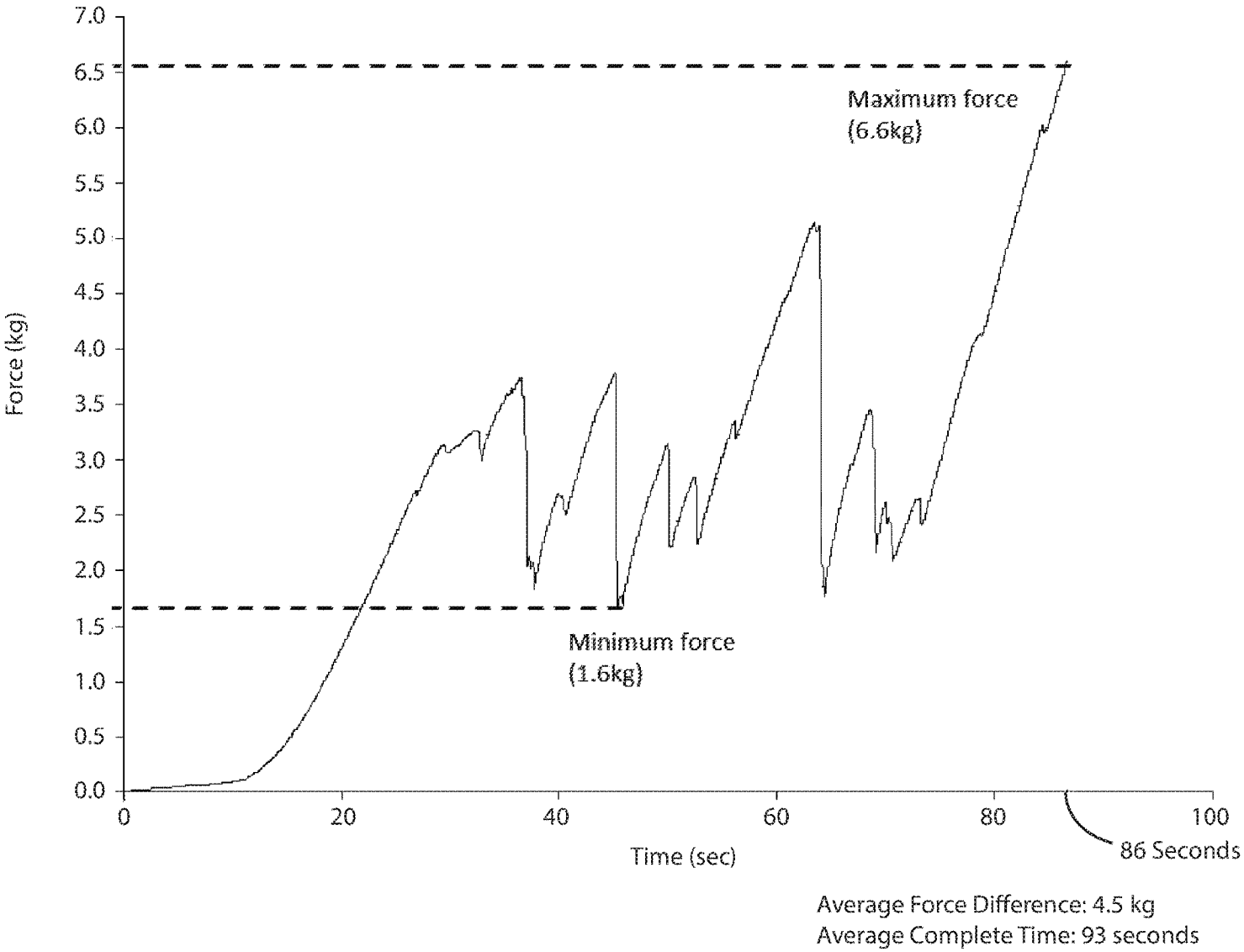
FIG. 11 is a graph showing force versus time for compression of a food product in accordance with various embodiments herein.

As a starting position, the probe was 30 mm above the sample. The probe was lowered into contact with the pouch and then moved 20 mm into the pouch (the press distance). The pre-test speed was set to 1.0 mm/s (e.g., before the probe makes contact with the pouch), the test speed was set to 0.2 mm/s (e.g., probe compressing pouch), and the post-test speed was set to 2.0 mm/s (e.g., probe returning to starting position). The texture analyzer captured force measurements during each step of the pressing procedure. The maximum force for the texture analyzer was 6.6 kg, therefore if the maximum force was hit, the trial was terminated (test failure). Movement into the pouch a distance of 20 mm at 0.2 mm/s provides a normal test completion time of 100 seconds. In cases herein where the average time is less than 100 seconds, it means that at least one trial was terminated based on hitting the maximum force of 6.6 kg. FIG. 11 described below is an example of trial termination before 100 seconds.

Figure 10:
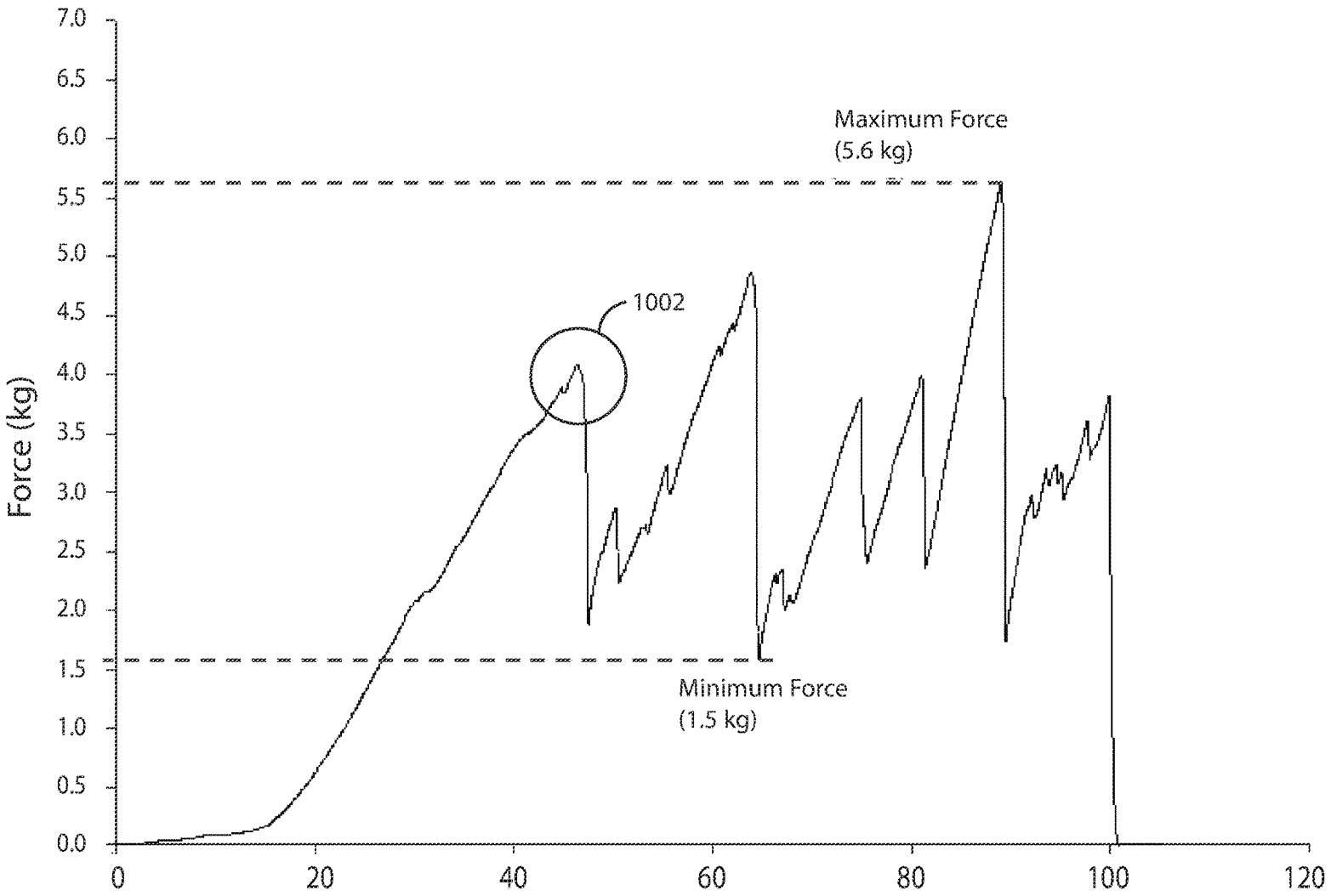
FIG. 10 is a graph showing force versus time for compression of a food product in accordance with various embodiments herein.

FIG. 10 shows a graph of pressure measurements associated with compression of a salsa food material in a deformable container herein. The first substantial downward pressure slope 1002 after an initial and gradual climb reflects initial valve opening. After that time, food material begins to flow out of the valve with fluctuations in pressure. The magnitude of the fluctuations (minimum force to maximum force) can be taken as an indication of the desirability of flow properties. A large magnitude of fluctuation can indicate inconsistent rates of flow and significant variations in the amount of pressure required to maintain flow. In this case, the maximum force was 5.6 kg and the minimum force was 1.5 kg, representing a magnitude difference of 4.1 kg. This experiment was repeated with the same parameters (same pouch, valve, food material, etc.) and the results are shown in FIG. 11. In the second trial, the force hit the maximum for the texture analyzer after 86 seconds and so the test was stopped at that point. The average force difference between the two trials was found to be 4.5 kg with an average completion time of 93 seconds (e.g., (100 seconds+86 seconds)/2).

Figure 12:
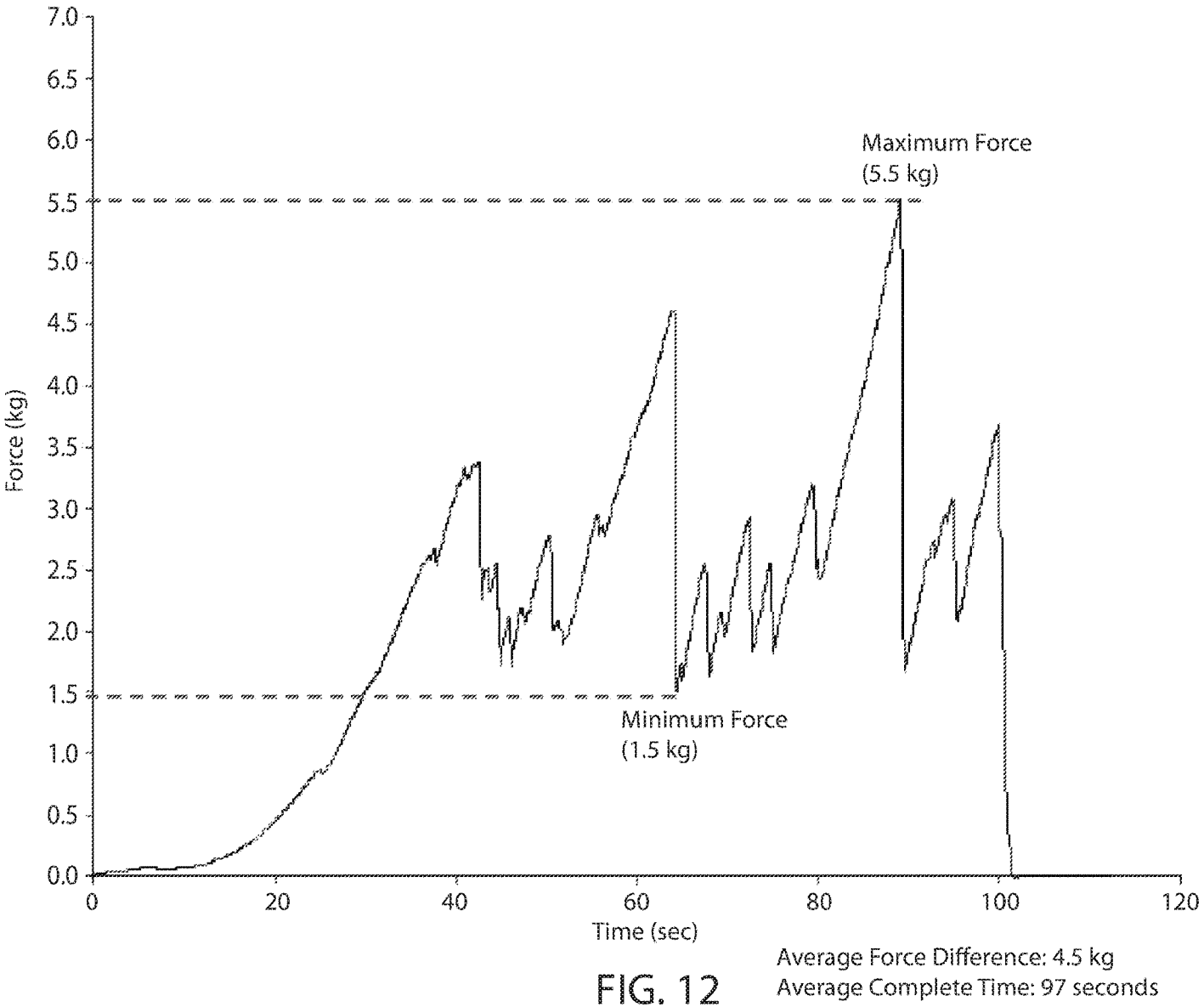
FIG. 12 is a graph showing force versus time for compression of a food product in accordance with various embodiments herein.
Figure 13:
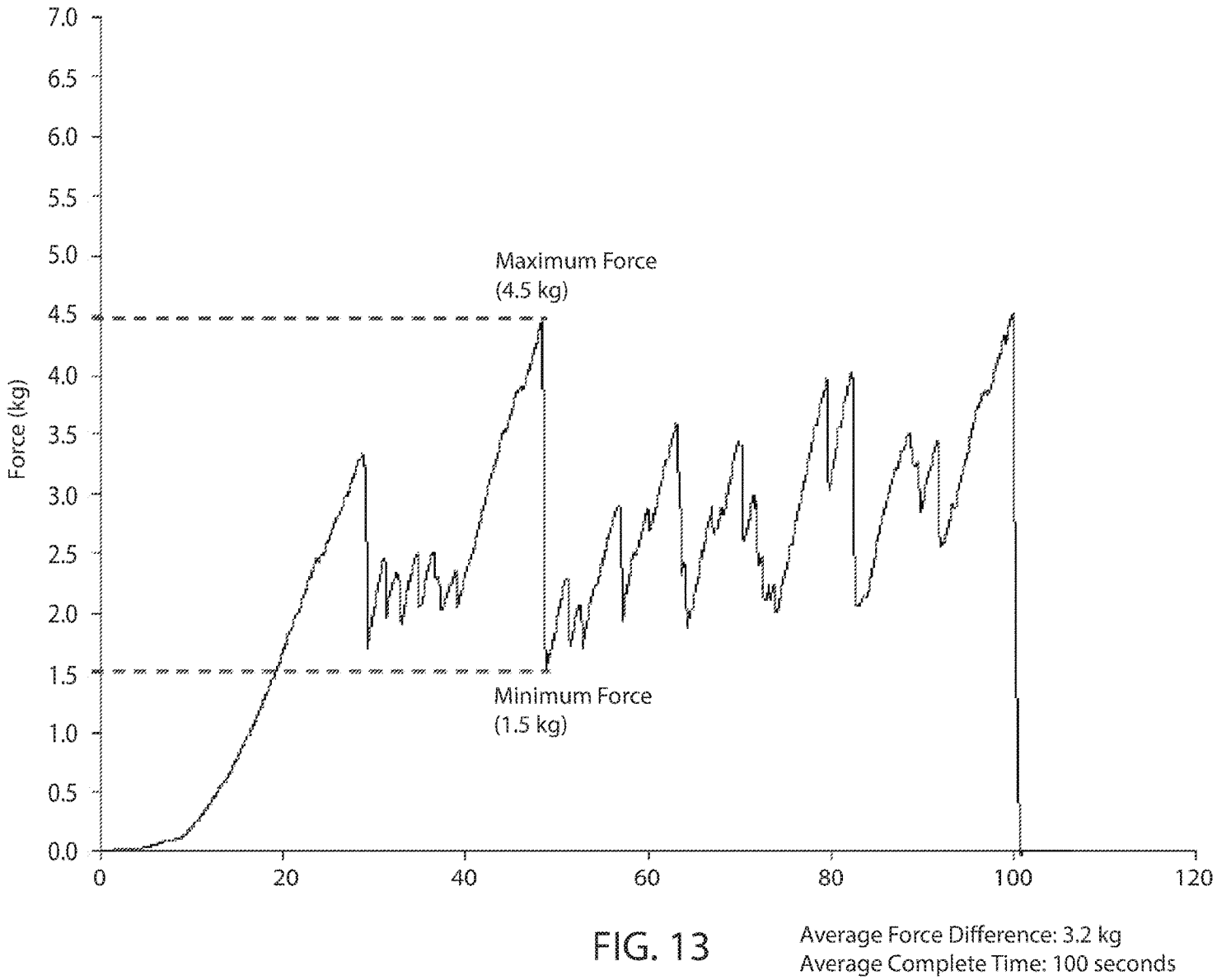
FIG. 13 is a graph showing force versus time for compression of a food product in accordance with various embodiments herein.

The experiment was repeated, but using a food material formulation with its viscosity increased through the addition of 10% more tomato paste over a base formulation, but keeping other parameters the same. The results are shown in FIG. 12. After two trials, it was found that the magnitude of the fluctuations after valve opening was 4.5 kg on average with a completion time of 97 seconds. The experiment was repeated again, but using a food material formulation with its viscosity increased through the addition of 20% more tomato paste over a base formulation (the base formulation including an amount of tomato paste), but keeping other parameters the same. The results are shown in FIG. 13. After two trials, it was found that the magnitude of the fluctuations after valve opening was 3.2 kg on average with a completion time of 100 seconds.

Figure 14:
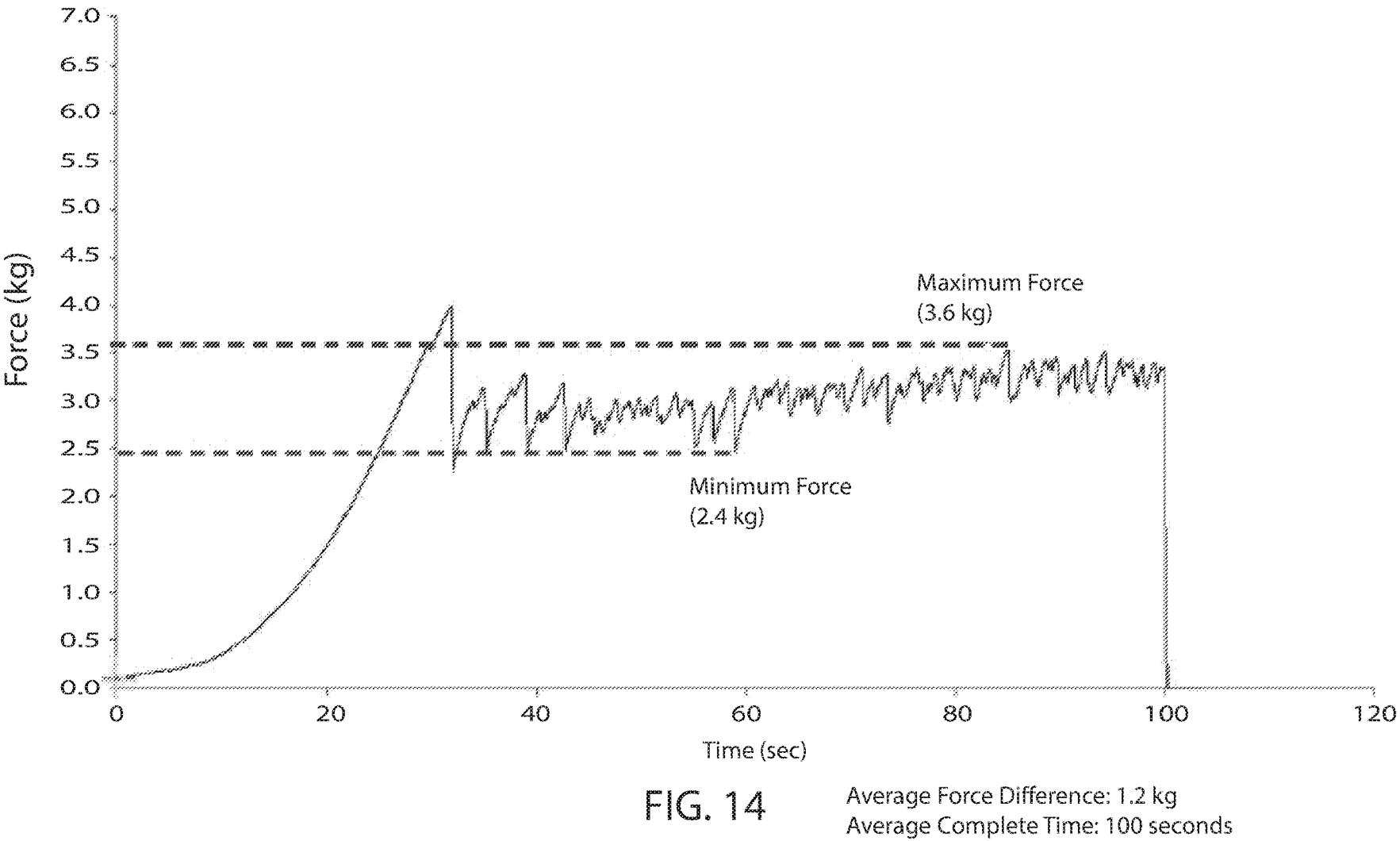
FIG. 14 is a graph showing force versus time for compression of a food product in accordance with various embodiments herein.

The experiment was repeated again, but using a food material formulation with its viscosity increased through the addition of 30% more tomato paste over a base formulation (the base formulation including an amount of tomato paste), but keeping other parameters the same. The results are shown in FIG. 14. After two trials, it was found that the magnitude of the fluctuations after valve opening was 1.2 kg on average with a completion time of 100 seconds. This example shows that increased viscosity lead to reduced magnitude of the fluctuations (minimum force to maximum force) and more desirable flow characteristics. This example also shows that increased viscosity lead to increased completion times which is also indicative of desirable flow characteristics.

Example 2: Effect of Solid Phase Particulate Sizes on Product Dispensing

Further testing was performed to determine the effect of solid phase particulate sizes on flow characteristics and product dispensing. Testing was performed in a similar manner to that described for Example 1 above. Particle size was varied (with the indicated size indicating a parameter on a cutting machine used to prepare the solid phase materials) along with viscosity (based on addition of tomato paste as described above). Testing was stopped if the measured pressure exceeded a value of 6.6 kg. Thus, failure to complete a test indicates an event where flow was effectively interrupted.

The results are shown below in Table 1 (wherein % TP indicates % by weight of tomato paste in the composition). This example shows that larger particle sizes made it difficult to achieve desirable flow characteristics. However, all other things being equal, increased viscosity surprising had a positive effect on flow characteristics even for larger particle sizes.

| Particulate Size/ Viscosity | Test Completion |
|---|---|
| ⅛"/20% TP | +* |
| ¼"/20% TP | – |
| ⅜"/20% TP | – |
| ⅛"/30% TP | +* |
| ¼"/30% TP | + |
| ⅜"/30% TP | – |

+ Indicates test completion.
– Indicates test failure.
*Indicates force magnitude fluctuations less than 2.9 kg.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

As used herein, the recitation of numerical ranges by endpoints shall include all numbers subsumed within that range (e.g., 2 to 8 includes 2.1, 2.8, 5.3, 7, etc.).

The headings used herein are provided for consistency with suggestions under 37 CFR 1.77 or otherwise to provide organizational cues. These headings shall not be viewed to limit or characterize the invention(s) set out in any claims that may issue from this disclosure. As an example, although the headings refer to a "Field," such claims should not be limited by the language chosen under this heading to describe the so-called technical field. Further, a description of a technology in the "Background" is not an admission that technology is prior art to any invention(s) in this disclosure. Neither is the "Summary" to be considered as a characterization of the invention(s) set forth in issued claims.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A food product comprising:

a deformable container comprising a first flexible side wall comprising a top perimeter portion, a first side perimeter portion, and a second side perimeter portion, and a bottom perimeter portion;

a second flexible side wall comprising a top perimeter portion, a first side perimeter portion, and a second side perimeter portion, and a bottom perimeter portion;

the first flexible side wall and second flexible side wall defining an interior volume;

wherein the first flexible side wall and the second flexible side wall are attached to one another along the top perimeter portion, the first side perimeter portion, and the second side perimeter portion;

wherein the deformable container deforms under an applied force to a deformed state retaining a spring potential energy of less than 25% of the work associated with the applied force;

wherein the first flexible side wall and second flexible side wall are attached to one another along a top perimeter portion, a first side perimeter portion, and a second side perimeter portion;

the first flexible side wall and the second flexible side wall forming a neck portion along their bottom perimeter portions defining a channel in fluid communication with the interior volume thereof; and a pressure operated dispensing valve in fluid communication with the channel; and a food material disposed within the interior volume, the food material comprising a liquid phase, and a solid phase, wherein the food material has a drain weight of at least 10% and less than 50% when evaluated using a #12 sieve;

wherein the food material has a viscosity at 22.5 degrees Celsius of 12 Pa·s to 560 Pa·s at a shear rate of 0.1 [1/s].

2. The food product of claim 1, wherein the food material is expelled from the deformable container under an externally applied force of at least 3 kg as measured with a 60 mm diameter aluminum cylinder probe at a test speed of 0.2 mm/s.

3. The food product of claim 1, wherein the pressure operated dispensing valve comprising an opening differential pressure of between 0.1 and 1 PSI.

4. The food product of claim 1, wherein an average force required for flow of the food material out of the pressure operated dispensing valve is less than 2.5 kg different than an average force required for valve opening at room temperature as measured with a 60 mm diameter aluminum cylinder probe at a test speed of 0.2 mm/s.

5. The food product of claim 1, wherein a specific gravity of the solid phase is greater than 0.7.

6. The food product of claim 1, wherein a specific gravity of the solid phase differs from a specific gravity of the liquid phase by less than 0.4.

7. The food product of claim 1, wherein the first side wall and the second side wall are substantially inelastic.

8. The food product of claim 1, the food product comprising a shelf-stable food product.

9. The food product of claim 1, the food material having a pH of 4.6 or less.

10. The food product of claim 1, the food material comprising from 8 to 40% by weight of tomato paste.

11. The food product of claim 1, the food material comprising from 20 to 30% by weight of tomato paste.

12. The food product of claim 1, the food material comprising from 23.6 to 28.6% by weight of tomato paste.

13. The food product of claim 1, the food material comprising from 8 to 30% by weight of tomato paste and a viscosity modifier.

14. The food product of claim 1, wherein a maximum width of the interior volume is less at a top portion of the deformable container than at a middle portion of the deformable container.

15. The food product of claim 1, wherein a maximum width of the interior volume tapers from a middle portion of the deformable container to a top portion of the deformable container and from the middle portion of the deformable container to a bottom portion of the deformable container.

16. The food product of claim 1, wherein a volume of air within the interior volume is less than 5%.

17. The food product of claim 1, wherein an average maximum size of particulates in the food material is less than 0.75 inches.

18. The food product of claim 1, pressure operated dispensing valve comprising a snowflake flap pattern.

19. The food product of claim 1, pressure operated dispensing valve comprising a membrane with cuts along more than two lines.

* * * * *